US006125563A

United States Patent [19]

Girerd

[11] Patent Number: 6,125,563

[45] Date of Patent: Oct. 3, 2000

[54] CONTAINER LABEL WITH HANDLE FLAP

[76] Inventor: Philippe H. Girerd, 5112 Caledonia Rd., Richmond, Va. 23225

[21] Appl. No.: 08/799,963

[22] Filed: Feb. 14, 1997

[51] Int. Cl.[7] ..... G09F 3/00

[52] U.S. Cl. ..... 40/310; 40/638; 315/396; 16/110.5

[58] Field of Search ..... 40/306, 310, 312, 40/638, 665, 316, 630, 673, 642.01; 283/81; 215/396, 398, 399; 16/110.5; D9/434; 206/806

[56] References Cited

U.S. PATENT DOCUMENTS

| | | | |
|---|---|---|---|
| 1,999,878 | 4/1935 | La Bombard | 229/402 |
| 2,135,306 | 11/1938 | Hyndman | 40/310 |
| 2,194,220 | 3/1940 | Elder | 40/306 X |
| 2,775,382 | 12/1956 | Kayat | 229/402 |
| 3,227,268 | 1/1966 | Gringer | 40/673 X |
| 3,623,633 | 11/1971 | Kinn | D9/434 X |
| 4,211,805 | 7/1980 | Chamberlin . | |
| 4,269,308 | 5/1981 | Platt | 206/150 |
| 4,884,827 | 12/1989 | Kelley | 40/316 X |
| 4,943,017 | 7/1990 | Ennis | 248/102 |
| 5,135,125 | 8/1992 | Andel et al. | 40/310 X |
| 5,145,108 | 9/1992 | Pinckney et al. . | |
| 5,183,169 | 2/1993 | Grzych . | |
| 5,255,947 | 10/1993 | Schwartz . | |
| 5,273,156 | 12/1993 | Harris | 206/147 |
| 5,325,982 | 7/1994 | Cobb, Jr. . | |
| 5,406,808 | 4/1995 | Babb et al. . | |
| 5,413,231 | 5/1995 | Carroll et al. . | |
| 5,413,232 | 5/1995 | Bergner et al. . | |
| 5,413,261 | 5/1995 | Wu . | |
| 5,422,152 | 6/1995 | Langeland et al. | 40/306 X |
| 5,467,915 | 11/1995 | Mattson . | |
| 5,484,167 | 1/1996 | Donaldson et al. | 40/310 X |
| 5,487,482 | 1/1996 | Rocheleau . | |
| 5,490,658 | 2/1996 | Coward et al. | 40/630 X |
| 5,575,096 | 11/1996 | Allegre | 40/306 |
| 5,639,529 | 6/1997 | Gozdecki et al. | 40/306 X |
| 5,647,624 | 7/1997 | Beshara, Jr. | 294/27.1 |
| 5,775,019 | 7/1998 | Johnson | 40/306 X |

FOREIGN PATENT DOCUMENTS

| | | | |
|---|---|---|---|
| 4126212 | 2/1993 | Germany | 40/306 |

*Primary Examiner*—Brian K. Green

[57] ABSTRACT

A container apparatus having a label for grasping the container to which it is attached includes a receiving surface and a label partially affixed to the container. The label includes a first portion of filmic material affixed to the receiving surface for displaying printed matter and a second portion of filmic material extending outward from the receiving surface, the second portion of filmic material having two back-to-back layers forming a handle of sufficient length to allow grasping thereof with one's fingers. The label-handle further includes an apparatus for affixing a label to a container in a fashion whereby the label forms a handle for grasping the container. The apparatus for affixing includes a unit for receiving and holding a container and a unit for wrapping a length of filmic material around the container, the unit for wrapping adhering a first portion of the filmic material to a receiving surface of the container while leaving second and third back-to-back portions of the filmic material free of the bottle and extending outward therefrom such that the second and third back-to-back portions form a handle.

4 Claims, 4 Drawing Sheets

CONTAINER LABEL WITH HANDLE FLAP

BACKGROUND OF THE INVENTION

1. Field of the Invention

The invention relates in general to labeling, and in particular to a container label which provides an overlapped excess portion which can be grasped and thereby used as a handle, and an apparatus for manufacturing such label.

2. Related Art

Various handle apparatus' have been provided in the prior art as an adjunct to articles such as bottles and other containers. U.S. Pat. No. 5,413,232 to Bergner et al. disclose a blown plastic container 2 and a supporting jacket 3 having a handle 5 for carrying the container. While the device of Bergner et al. is sufficient for providing an adjunct handle, e.g., one that is a separate construction from that of the bottle, such an arrangement is both expensive and complex in that it requires a separate manufacturing process in addition to the conventional bottle manufacturing/labelling process and requires further materials in addition to those required for the bottle absent the handle; Bergner et al. describe their jacket as being constructed of "cardboard or similar material."

U.S. Pat. No. 5,467,915 to Mattson discloses a lift-up handle which is attachable to a container such as a bottle (FIG. 6). Like the device of Bergner, Mattson's device is an adjunct which requires a separate manufacturing process. While Mattson's preferred embodiment is of a "polyethylene or similar polymer" construction, it is not a filmic polymer whose construction can be integrated into that of a conventional filmic bottle label.

U.S. Pat. No. 5,135,125 to Andel et al. disclose a label which has a "hanging ring" attached thereto for suspending a container to which the label is attached. The hanging ring in the device of Andel et al. is formed by die-cutting a portion of the label; the hanging ring portion is then separated by peeling it away from the remaining portion of the bottle.

OBJECTS AND SUMMARY OF THE INVENTION

It is therefore an object of the invention to provide a container handle which is made integral with the container's label and which facilitates handling of the container.

It is a further object of the invention to provide a container handle whose manufacture can be integrated with the conventional container manufacturing/labelling process.

It is a further object of the invention to provide an improved method and apparatus for label manufacture in which the end product is a label with an integrated handle.

The invention provides a container apparatus having a label which provides a means for grasping the container to which it is attached. The container includes a receiving surface and a label partially affixed to the container. The label includes a first portion of filmic material affixed to the receiving surface for displaying printed matter and a second portion of filmic material extending outward from the receiving surface, the second portion of filmic material having two back-to-back layers forming a handle of sufficient length to allow grasping thereof with one's fingers. The invention further includes an apparatus for affixing a label to a container in a fashion whereby the label forms a handle for grasping the container. The apparatus for affixing includes a unit for receiving and holding a container and a unit for wrapping a length of filmic material around the container, the unit for wrapping and adhering a first portion of the filmic material to a receiving surface of the container while leaving second and third back-to-back portions of the filmic material free of the bottle and extending outward therefrom such that the second and third back-to-back portions form a handle.

BRIEF DESCRIPTION OF THE DRAWINGS

The foregoing and other objects, features, and advantages of the invention will be apparent from the following more particular description of preferred embodiments as illustrated in the accompanying drawings, in which reference characters refer to the same parts throughout the various views. The drawings are not necessarily to scale, emphasis instead being placed upon illustrating principles of the invention.

DETAILED DESCRIPTION

Figure 1A:
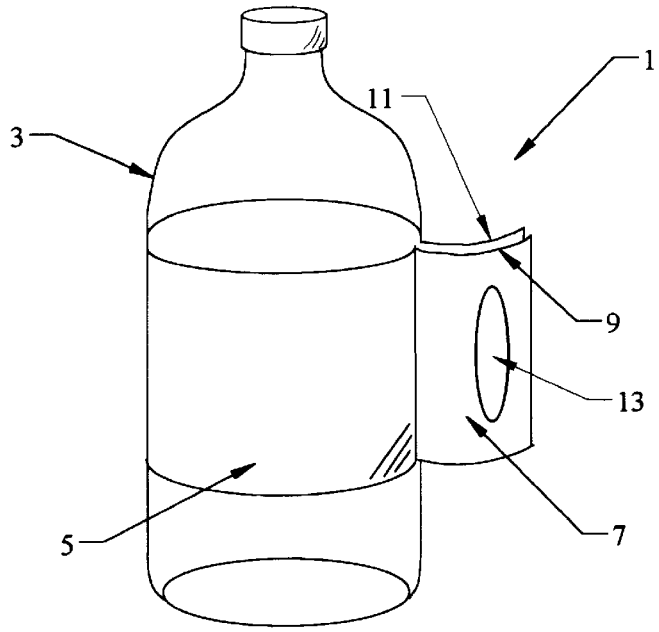
FIG. 1*a* shows a perspective view illustrating the invention according to a first embodiment in which the handle portion comprises the label ends.

With reference to FIG. 1*a,* the label-handle 1 according to a first embodiment of the invention includes a filmic material 5, preferably of a polymer composition similar to that of conventional container labels—e.g., oriented polypropylene film, woven material, mylar, or polymer film reinforced by a mesh of nylon threads. The filmic material 5 is cut to a length which is in excess of that which is required to cover the circumference of a container 5, which may be a two-liter soda bottle or other conventional container. In this manner, two excess portions 9, 11 are formed and extend outward from the bottle. The label is adhered to the bottle in a conventional manner, e.g., via a pressure-sensitive adhesive applied to one surface of the film or other adhesive spread onto the surface of the label.

This same adhesive allows the two excess portions 9, 11 to be adhered to each other to form a single handle portion 7. A void 13 is provided through the handle portion 7 to facilitate grasping of the handle portion with one's fingers or with an implement. The manner in which this void 13 is formed is described in further detail below.

Figure 1B:
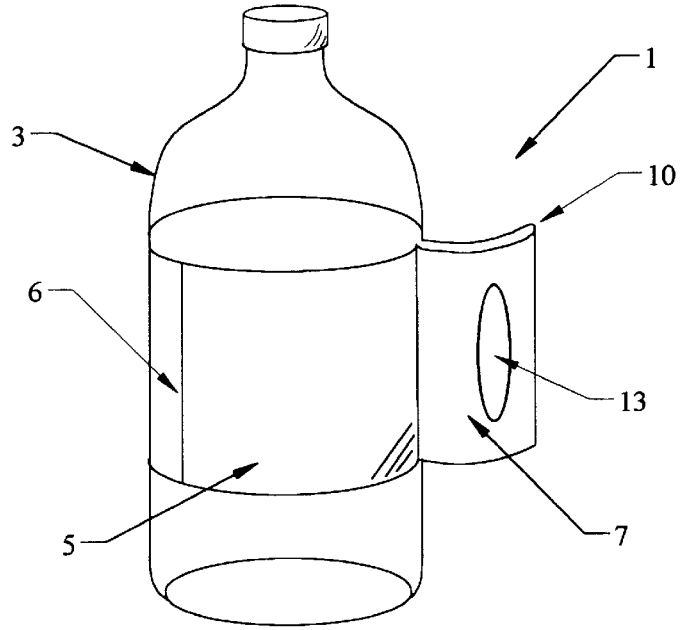
FIG. 1*b* shows a perspective view illustrating the invention according to a second embodiment in which the handle portion comprises a loop of excess label material.

As shown in FIG. 1*a,* the two excess portions 9, 11 which form the handle comprise opposite ends of the cut label. FIG. 1*b* shows a second embodiment of the invention in which the handle is formed by a single loop of excess label material 10, and the ends of the label form a seam 6 elsewhere on the bottle.

Figure 1C:
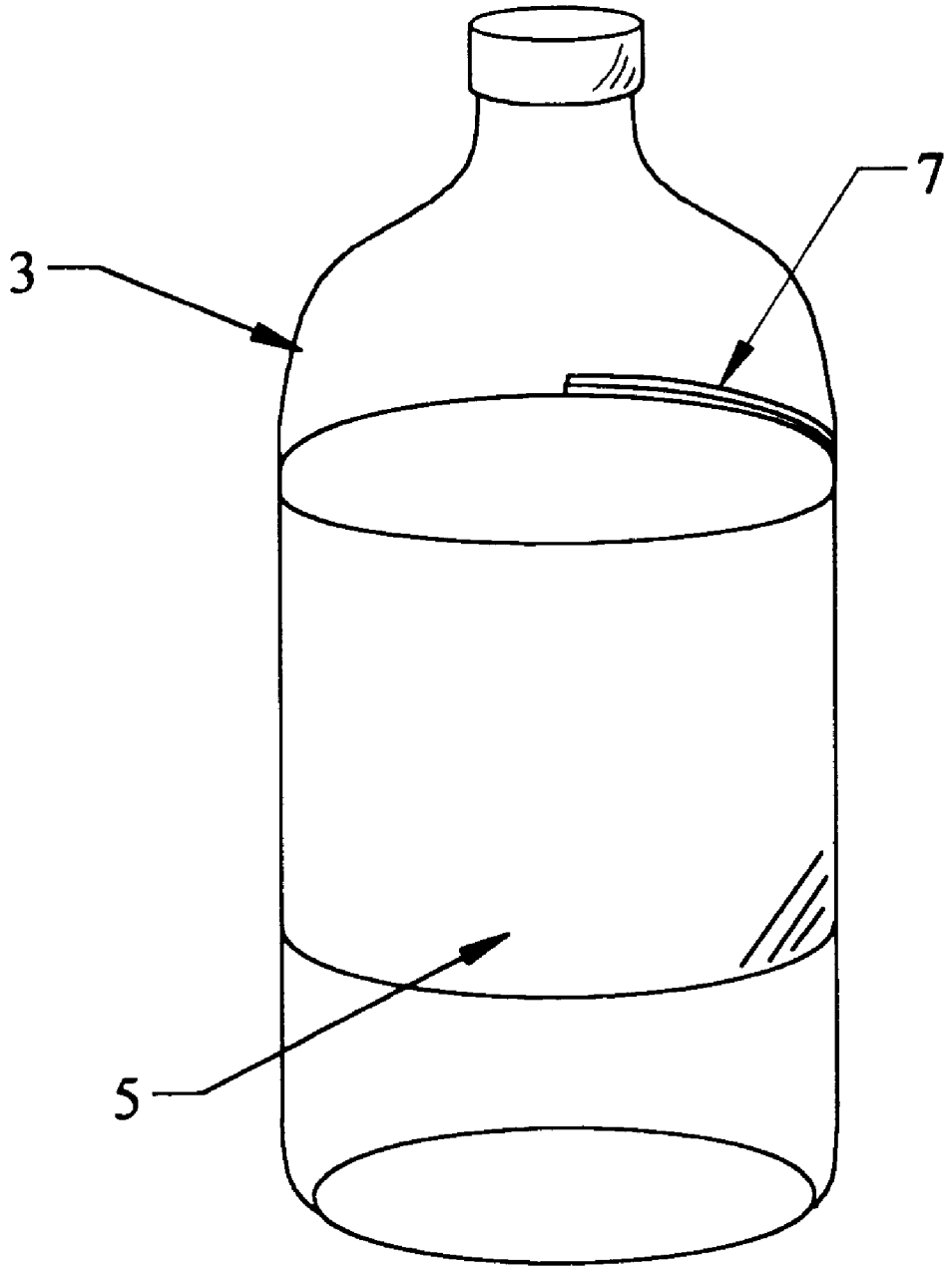
FIG. 1*c* shows a perspective view illustrating an embodiment of the invention in which a handle portion is folded over and adhered to a side face of a bottle.

With reference to FIG. 1*c*, the handle portion 7 of the label-handle thus applied can be folded over so as to be flush with the remainder of the label. The handle portion 7 can then be glued in place by a relatively weak adhesive. By so-folding over the handle portion 7, the bottle can be packaged or otherwise initially handled just as a conventionally-labelled bottle. The handle can then be detached to the position shown in FIG. 1*c* by the consumer or other person handling the bottle downstream from the manufacturer.

Figure 2:
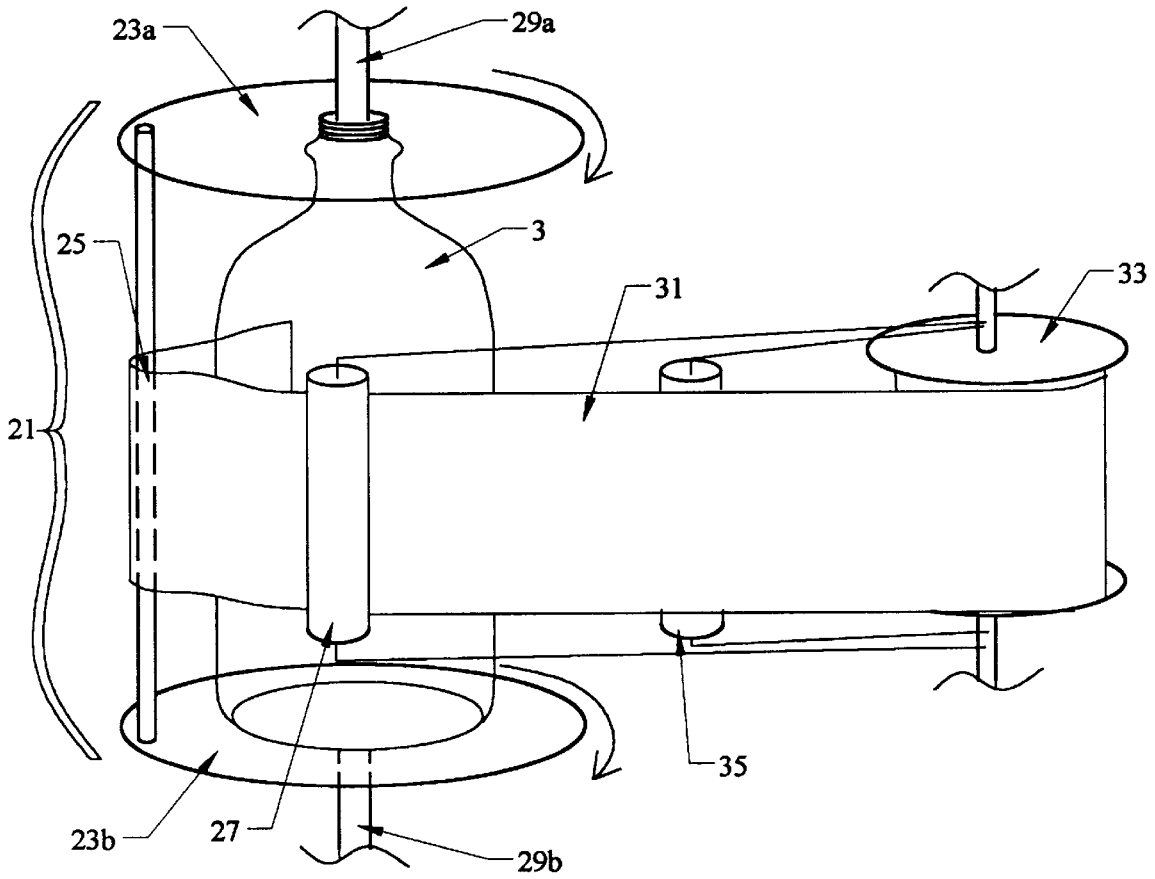
FIG. 2 shows a perspective view illustrating a label-handle application process and apparatus.

FIG. 2 illustrates a method of manufacturing/applying a label-handle of the invention. A bottle 3 is placed on a rotating "spinning unit" 21. The spinning unit 21 is comprised of a base 23*b* upon which the bottle 3 rests in an upright, centered position. The spinning unit 21 further comprises a top element 23*a* which keeps the bottle 3 centered, free of lateral non-rotational movement (wobble), and firmly applied to the base 23*b*. A vertical, spring-loaded handle-forming rod 25 is positioned at a sufficient distance from the bottle to allow initial formation of the handle portion of the label-handle during the wrapping process. The handle-forming rod 25 may be a permanent part of the spinning unit, or alternatively may be a portion of plastic tubing or rod which is fed into position and then cut free and retained in the handle portion as a reinforcement. It should be understood that other reinforcing means, such as rings or plates, may also be integrated into the handle for increased strength.

A label-applying unit comprises a reel 33 of filmic material 31, a web-guiding roller 35, and an applicator roller 27. The filmic material 31 is fed from the reel 33 at an appropriate rate and tension and is guided onto the spinning bottle 3 by the rollers 35 and 27. The roller 35 may also apply a layer of adhesive to the inside surface of the label. The adhesive may also be applied directly to the bottle if portions 9 and 11 are to remain not adhered to each other. The applicator roller 27 affixes the adhesive-laden leading edge of the label-handle to the outer surface of the bottle 3.

As the spinning unit rotates the bottle, the affixed leading edge of the label-handle causes the remainder of the label-handle to be dispensed as it is taken up around the bottle and the handle-forming rod 25. In this manner, the handle-forming rod holds a portion of the label-handle away from the bottle 3, thereby forming the excess or "slack" which is to be the handle portion. Finally, the trailing edge of the label-handle is affixed in an overlapped fashion on top of the leading edge (as is shown more clearly in FIG. 3). The label-handle is then cut free or otherwise detached along pre-existing perforations. It should be noted that, while FIG. 2 illustrates an apparatus and method for forming the label-handle of FIG. 1*b*, the label-handle of FIG. 1*a* could be manufactured using a method and apparatus similar to conventional methods/apparatus' for bottle-labelling but modified so as to retain the leading and trailing ends of the label away from the bottle surface and cause the leading and trailing ends to meet and adhere to one another.

Figure 3:
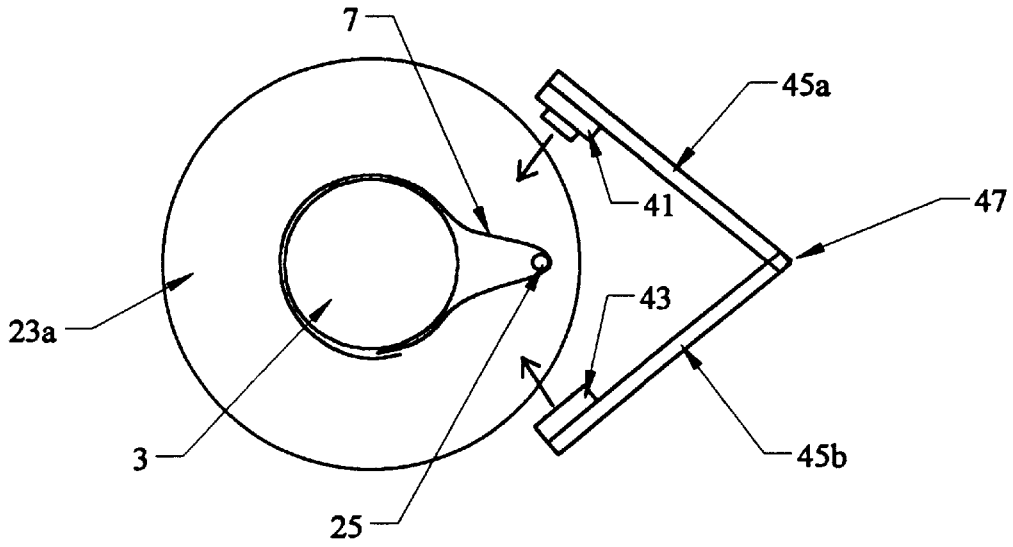
FIG. 3 shows a top view illustrating a handle-stamping unit according to the invention.

FIG. 3 illustrates the handle stamping unit which can be used if the label-handle as dispensed has no preformed void 13 (FIG. 1) for receiving fingers. The handle stamping unit comprises first and second stamping faces 41 and 43, respectively. The stamping faces 41 and 43 function to press the two sides of the label-handle together to stamp one or more voids 13 (FIG. 1) and also to apply a weak adhesive to one side of the handle portion whereby the handle can be pressed flat against the side wall of the bottle, as shown in FIG. 1*c*, and remain in such position during shipping and storage. The stamping faces 41 and 43 are attached to swinging arms 45*a* and 45*b*, respectively, which pivot about a pivot point 47 in such a manner that they strike the handle portion 7 of the label handle.

Figure 3A:
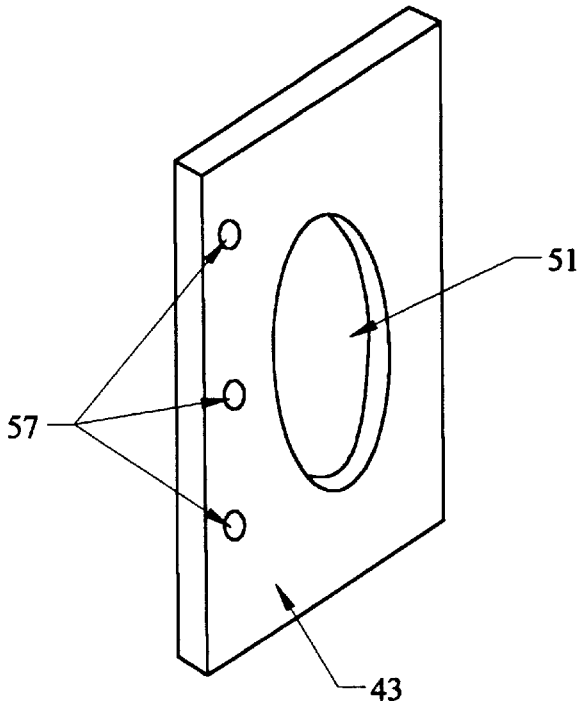
FIGS. 3*a* and 3*b* respectively illustrate a detailed perspective view of the first and second stamping faces shown in FIG. 3.
Figure 3B:
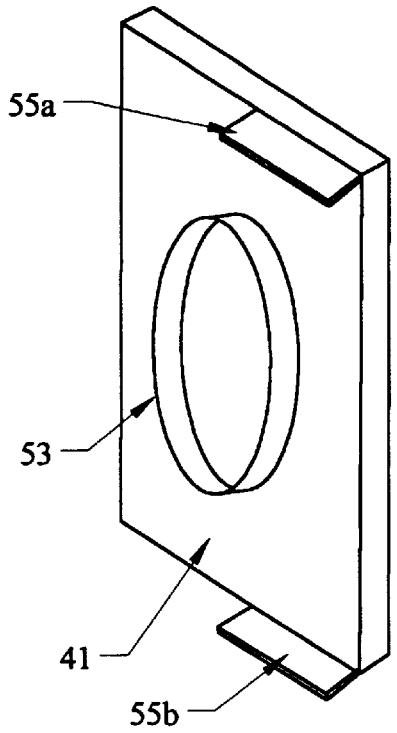

As shown in FIGS. 3*a* and 3*b*, the first stamping face 41 comprises a protuberant blade 53 while the second stamping face 43 comprises an opening 51 in its face. When the first and second stamping faces are pivoted inward toward each other, the protuberant blade 53 of the first stamping face 41 fits into the opening 51 of the second stamping face, whereby a hole in the handle portion 7 (FIG. 3) is punched.

A series of openings 57 are provided in the stamping face 43 for permitting the deposition of a small amount of a weak adhesive to one facing side of the handle portion 7 such that the handle portion can be retained in a folded-over position as described above. While the openings 57 are shown on the second stamping face 43, it will be understood by those skilled in the art that such openings may be provided on either the first or second stamping faces without departing from the spirit and scope of the invention. Blades 55*a* and 55*b* can be provided on either stamping face as well. Such blades can cut the handle-forming rod 25 simultaneously with the above-described stamping in an embodiment in which the label-forming rod 25 is intended to remain within the handle portion as a form of reinforcement. Various shapes and configurations of blades may be provided for shaping the exterior of the handle portion 7.

While the invention has been particularly shown and described with reference to preferred embodiments thereof, it will be understood by those skilled in the art that various changes in form and details may be made therein without departing from the spirit and scope of the invention. For example, the invention could be practiced using a continuous roll of preformed labels, e.g., a face stock laminated to a liner, with each label having a finger opening die-cut therefrom.

What is claimed is:

1. A storage apparatus having a label with a deployable handle flap comprising:

a container having a receiving surface, said container for delivering a contents;

said label formed of a broad ribbon of substantially thin and pliable unitary filmic material having a first segment and a second segment, said first segment being substantially longer than said second segment, said first segment being partially opacified by a front surface bearing printed material, said first segment bearing a rear surface attached to said container by an adhesive in such a manner as to permit lifting of said container by said second segment without slippage from said container when said container includes contents which weigh one pound or more, said second segment forming a handle flap being immediately adjacent to and sequentially following the first segment, said second segment forming a loop folded on itself with said fold being opposite to the container, said second segment including a void extending through the second segment in order to receive fingers, said second segment comprising back to back layers which directly engage one another along an entire distance upon which the second segment extends outwardly from the container, said second segment, while in a storage position, being folded at a junction between said first segment and the second segment, said second segment, while in a usage position, being allowed to sway freely about the junction with the first segment.

2. The apparatus of claim 1 wherein said second segment, while in the storage position, is attached to said first segment by an adhesive.

3. The apparatus of claim 1 wherein said back to back layers of the second segment are attached to each other by an adhesive.

4. The apparatus of claim 1 wherein said first segment is completely covered with printed material or otherwise opaque.

* * * * *